US007012205B1

(12) United States Patent
Han

(10) Patent No.: US 7,012,205 B1
(45) Date of Patent: Mar. 14, 2006

(54) BEZEL ASSEMBLY

(75) Inventor: Shao-Bo Han, Shenzhen (CN)

(73) Assignee: HON HAI Precision Industry Co., Ltd., (TW)

( * ) Notice: Subject to any disclaimer, the term of this patent is extended or adjusted under 35 U.S.C. 154(b) by 0 days.

(21) Appl. No.: 11/019,435

(22) Filed: Dec. 21, 2004

(30) Foreign Application Priority Data

Sep. 10, 2004 (CN) ..... 200420088245

(51) Int. Cl.
*H01H 1/36* (2006.01)

(52) U.S. Cl. ..... 200/252; 343/547

(58) Field of Classification Search ..... 200/252, 200/296, 293, 330, 332, 341, 343, 541, 547
See application file for complete search history.

(56) References Cited

U.S. PATENT DOCUMENTS 4,816,626 A * 3/1989 Valenzona et al. ..... 200/16 F
5,739,486 A * 4/1998 Buckingham ..... 200/5 A
5,817,997 A * 10/1998 Wernig ..... 200/16 R
6,054,662 A * 4/2000 Hrehor et al. ..... 200/332
6,160,232 A * 12/2000 Lin ..... 200/341
6,570,112 B1 * 5/2003 Lin ..... 200/343
6,667,447 B1 12/2003 Liu et al.

FOREIGN PATENT DOCUMENTS

TW 562230 11/2003

* cited by examiner

*Primary Examiner*—Kyung Lee
(74) *Attorney, Agent, or Firm*—Morris, Manning & Martin, LLP; Tim Tingkang Xia, Esq.

(57) ABSTRACT

A bezel assembly includes a bezel (10), a button (20) slidably attached to the bezel from outside, a relaying member (30) resiliently accordingly attached to the bezel from inner side. The bezel is attached on a front plate (80) of an electronic device. A switch (90) is held in a bracket (70) and the bracket is secured in the front plate. The button includes a mating shaft (26). The relaying member includes a pair of vertical boards (32). A mating slot (341) is defined in one of the vertical plates, for engagingly receiving the mating shaft. When the button is pushed inwardly, the mating shaft engages with mating slot of the relaying member. Accordingly, the vertical board moves inwardly to actuate the switch.

20 Claims, 3 Drawing Sheets

BEZEL ASSEMBLY

BACKGROUND OF THE INVENTION

1. Field of the Invention

The present invention relates to bezel assembly, and more particularly to a bezel assembly with a button relaying member which reliably operates a button thereof to actuate a switch.

2. Description of the Related Art

Many electronic products have bezels attached to their front faces. Any typical product among a variety of electronic products has a variety of controlling buttons attached to its bezel. A contacting pole extrudes from the back of each button, for actuating a trigger of a switch of an appropriate controlling circuit when the button is pushed. A spring is placed around each contacting pole, to enable the button to return to its original position. However, the contacting pole of the button and the trigger of the switch are both small parts of these tiny components. This leads a limited engaging area between the button and the switch. Furthermore, manufacture and location tolerances always exists, it also reduces the engaging area or even causes no any touches therbetween. All of above may lead the predetermined operation to being unliabe or unenforceable. Furthermore, the contacting pole of the button is prone to be blocked in the electronic product, and can not be restored by the spring.

An improved bezel assembly which overcomes the above-mentioned problems is desired.

SUMMARY OF THE INVENTION

Accordingly, an object of the present invention is to provide a bezel assembly which reliably operates a button thereof to actuate a switch.

To achieve the above object, a bezel assembly in accordance with the present invention comprises a bezel, a button slidably attached to the bezel from outside, a relaying member resiliently accordingly attached to the bezel from inner side. The bezel is attached on a front plate of an electronic device. A switch is held in a bracket and the bracket is secured in the front plate. The button includes a mating shaft. The relaying member includes a pair of vertical boards. A mating slot is defined in one of the vertical plates, for engagingly receiving the mating shaft. When the button is pushed inwardly, the mating shaft engages with mating slot of the relaying member. Accordingly, the vertical board moves inwardly to actuate the switch.

Other objects, advantages and novel features of the present invention will be drawn from the following detailed description of preferred embodiments of the present invention with the attached drawings, in which:

DETAILED DESCRIPTION OF THE PRESENT INVENTION

Figure 1:
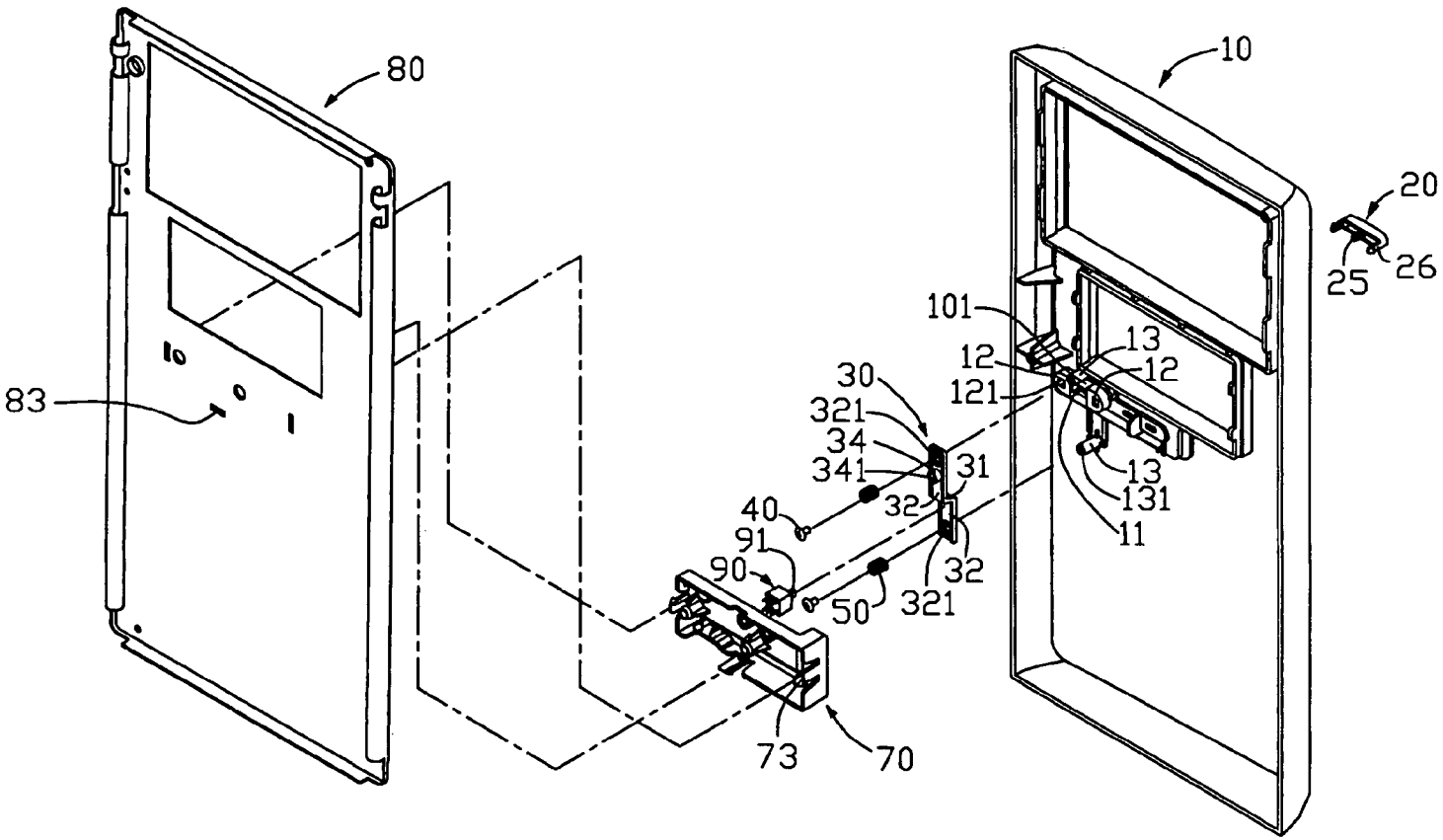
FIG. 1 is an exploded, isometric view of bezel assembly in accordance with a preferred embodiment of the present invention together with a switch, a bracket, and a front plate.

Referring to FIG. 1, a bezel assembly in accordance with the preferred embodiment of the present invention comprises a bezel 10, a button 20 slidably attached to the bezel 10 outward, and a relaying member 30 resiliently attached to the bezel 10 inward by resilient members 50 and fasteners 40. A switch 90 is fixed on a front plate 80 of an electronic device (not shown) by a bracket 70. When the button 10 is pushed inwardly, the relaying member 30 is accordingly moved to actuate the switch 90 to break or open an electronic circuit.

Figure 2:
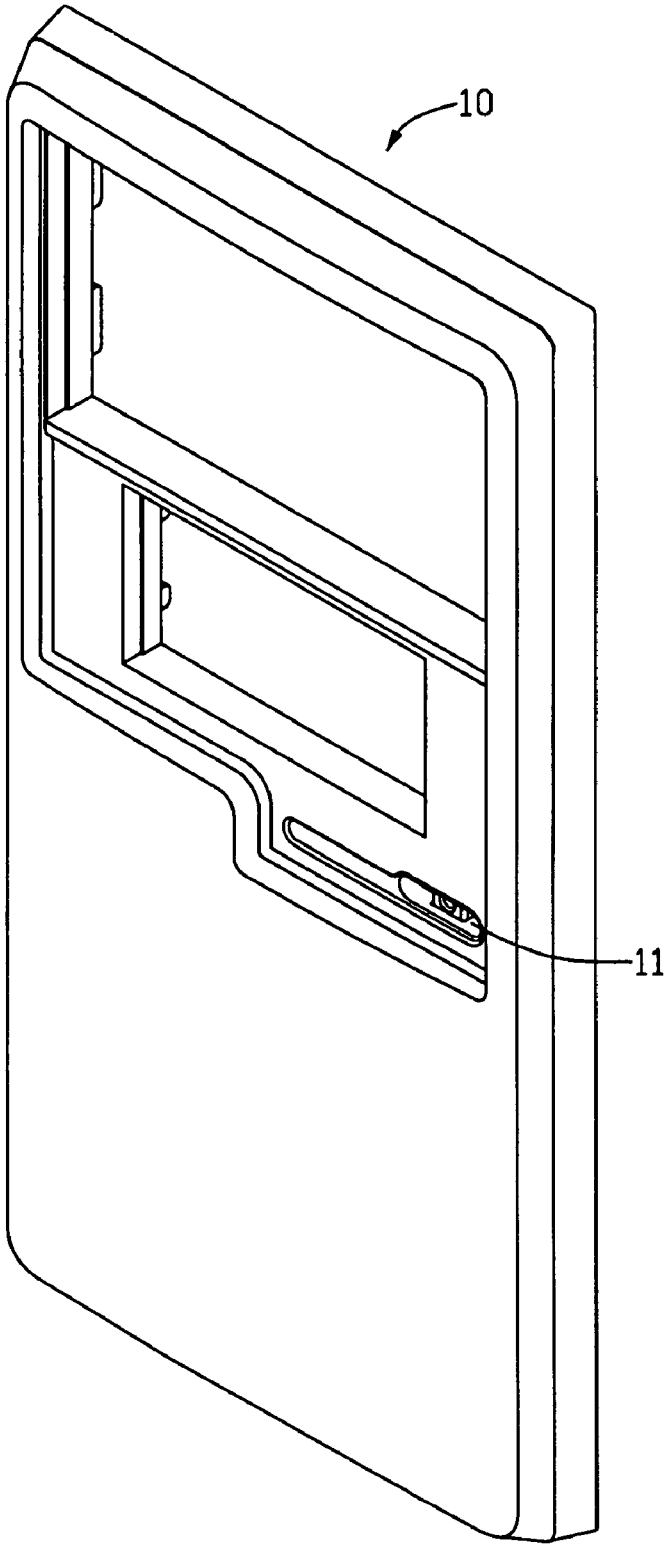
FIG. 2 is an isometric view of a bezel of FIG. 1, but viewed from another aspect.

Referring also to FIG. 2, the bezel 10 extends a projecting portion 101 inwardly from an inner surface thereof. A recess 11 is defined in the bezel 10 and through the projection portion 101, for slidably receiving the button 20 therein. A pair of protrusions 12 extends inwardly at opposite longitudinal ends of the recess 11 from the projecting portion 101. A pair of poles 13 extends inwardly besides latitudinal sides of the recess 11 from the inner surface of the bezel 10. A first through hole 121 is defined in each protrusion 12. A threaded hole 131 is defined in each pole 13.

The button 20 is generally a hollow parallelepiped body with one open face. The button 20 comprises a convex end (not labelled) facilitating manual pressing. A pair of clasps 26 extends from opposite sides of the concave end respectively, and a mating shaft 25 extends from a middle of the concave end.

The relaying member 30 comprises a middle board 31, a pair of vertical boards 32 extending perpendicularly from two opposite ends of the middle board 31 in opposite directions. A second through hole 321 is defined in each vertical board 32 near free ends thereof. A post 34 extends inwardly from an upper vertical board 32. A mating slot 341 is defined through the post 34 and the vertical board 32, for engagingly receiving the mating shaft 25 of the button 20.

The switch 90 comprises a trigger 91 and is attached to a front plate 80 of the electronic device by the bracket 70. The bracket 70 comprises a plurality of hooks 73 extending outwardly and defines a receiving space (not shown) for holding the switch 90 therein. The front plate 80 defines a plurality of apertures 83, engaging with the hooks 73 to attach the bracket 70 to the front plate 80.

Figure 3:
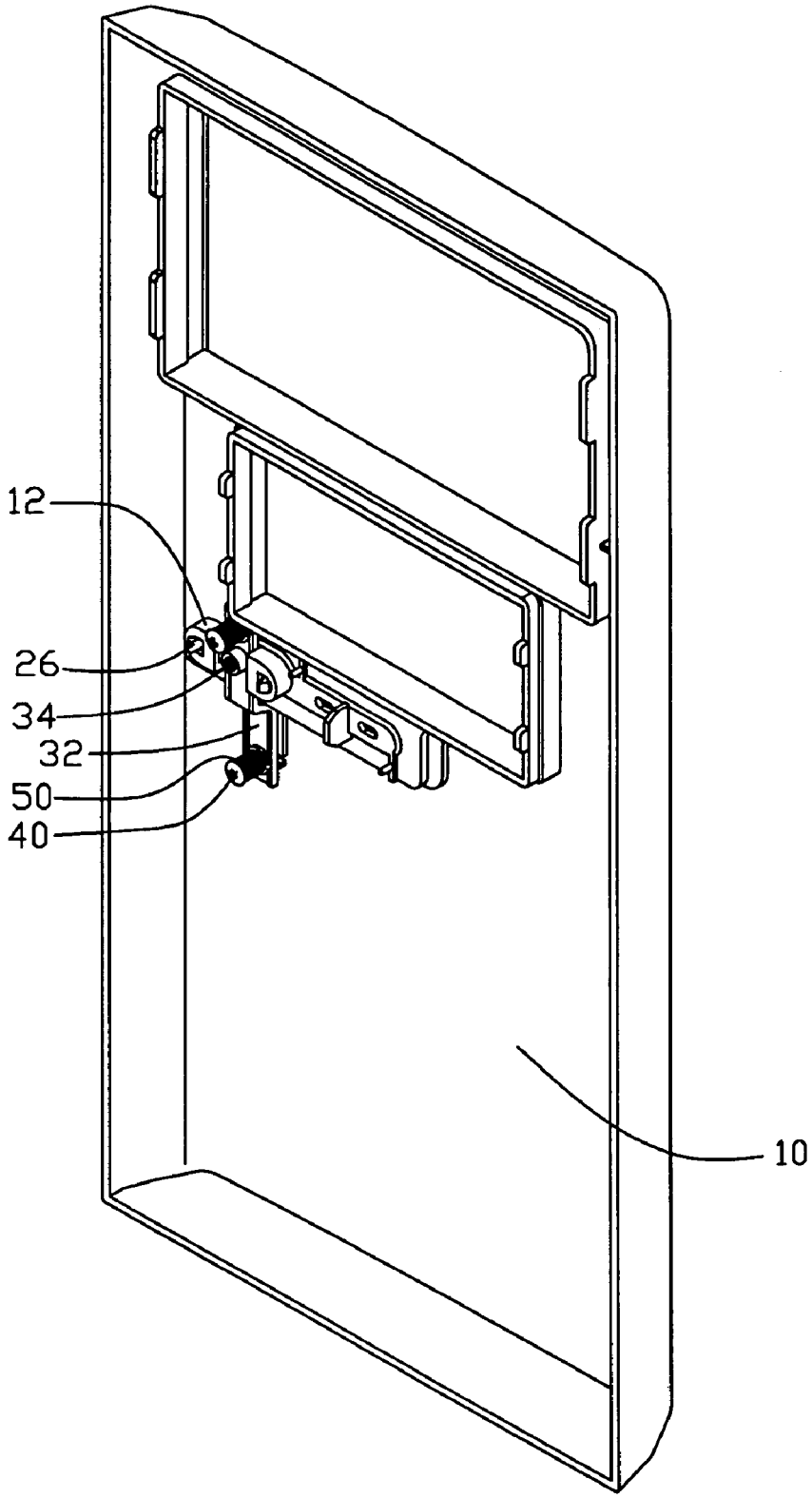
FIG. 3 is an assembled view the bezel assembly of FIG. 1.

Referring also to FIG. 3, in assembly of the bezel assembly, the button 20 and the relaying member 30 are respectively mounted on the bezel 10 from two opposite directions. The button 20 is slidably disposed in the recess 11 of the bezel 10 from outside, with the clasps 26 extended through the first through holes 121 of the protrusions 12 and engaging with end surfaces of the protrusions 12. The relaying member 30 is attached to the bezel 10 from inside, with the poles 13 extended through the through holes 321 of the relaying member 30. The mating shaft 25 of the button 20 engagingly received in the mating slot 341 of the relaying member 30. The resilient members 50 are placed around the poles 13 and the fasteners 40 are screwed into the threaded holes 131 of the poles 13. Thus, the relaying member 30 is resiliently attached to the inner side of the bezel 10 and the upper vertical boards 32 movably contacting the projecting portion 101. Then, the bracket 70 is mounted to the front plate 80, with the hooks 73 engaging in corresponding apertures 83 of the front plate 80. The switch 90 is retained in the bracket 70, with the trigger 91 extending outwardly toward the relaying member 30. Finally, the combined bezel 10 is attached to the front plate 80.

In usage, When the button 20 is pushed inwardly, the mating shaft 25 engages with mating slot 341 of the relaying member 30. Accordingly, the vertical board 32 moves inwardly to actuate the trigger 91 of the switch 90 and the resilient members 50 are depressed. When the button 20 is released, the resilient members 50 resiliently return to their original state. Thus, the button 20 moves outwardly to its initial position for users' following operations. The button 20 actuates the switch 90 via the relaying member 30, other than directly contacts the trigger 91. As a result, the button 20 moves easily back to its original position without any obstacles.

While the present invention has been illustrated by the description of the preferred embodiments thereof, and while the preferred embodiments have been described in considerable detail, it is not intended to restrict or in any way limit the scope of the appended claims to such detail. Additional advantages and modifications within the spirit and scope of the present invention will readily appear to those skilled in the art. Therefore, the present invention is not limited to the specific details and illustrative examples shown and described.

What is claimed is:

1. A bezel assembly attached on a front plate of an electronic device, the front plate installing a switch, the bezel assembly, comprising:

a bezel defining a recess;

a button slidably received in the recess, the button comprising a pair of clasps engaging with the bezel, and a mating shaft; and a relaying member resiliently attached to an inside of the bezel, the relaying member defining a mating slot to engagingly receive the mating shaft of the button;

wherein when the button is pushed, the relaying member is accordingly moved to actuate the switch.

2. The bezel assembly as claimed in claim 1, wherein the bezel comprises a pair of protrusions disposed at opposite ends of the recess, a through hole is defined in each of the protrusions, the clasps of the button are extended through the through holes and engage with end surfaces of the protrusions.

3. The bezel assembly as claimed in claim 1, wherein the relaying member comprises a middle board, and a pair of vertical boards extending perpendicularly from opposite ends of the middle board in two opposite directions.

4. The bezel assembly as claimed in claim 3, wherein a hollow post extends from one of the vertical boards, the mating slot is extended through the post.

5. The bezel assembly as claimed in claim 3, wherein the vertical boards each define a through hole therein, a pair of poles extends inward from an inner side of the bezel besides the recess, for extending through the through holes of the vertical boards.

6. The bezel assembly as claimed in claim 5, wherein the poles each define a threaded hole therein, the bezel assembly further comprises a pair of resilient members placing around the poles, and a pair of fasteners engaging in the threaded holes.

7. A bezel assembly comprising:

a front plate adapted to be attached to an electronic device;

a bezel attached to the front plate; and a button assembly disposed between the bezel and the front plate, the button assembly comprising a button slidably mounted in the bezel, a switch correspondingly fixed on the front plate, and a relaying member resiliently attached to an inner side of the bezel and moved by the button to actuate the switch.

8. The bezel assembly as claimed in claim 7, wherein the bezel defines a recess for holding the button therein.

9. The bezel assembly as claimed in claim 8, wherein the button comprises a pair of clasps extending from two ends thereof, the bezel comprises a pair of protrusions extending inwardly adjacent two longwise ends of the recess, a through hole is defined in each protrusion, the clasps are extended through the through holes and engage end surfaces of the protrusions.

10. The bezel assembly as claimed in claim 7, wherein the button comprises a mating shaft extending outwardly, the relaying member defines a mating slot for engagingly receiving the mating shaft.

11. The bezel assembly as claimed in claim 10, wherein the relaying member comprises a middle board, and a pair of vertical boards extending perpendicularly from two ends of the middle board in opposite directions.

12. The bezel assembly as claimed in claim 11, wherein a through hole is defined in each vertical board, a pair of poles extends inwardly from an inner surface of the bezel besides the recess for extending through the through holes.

13. The bezel assembly as claimed in claim 12, wherein a threaded hole is defined in each pole, a pair of resilient members is placed around the poles of the bezel and a pair of fasteners engages in the threaded holes to resiliently attach the relaying member to the bezel.

14. The bezel assembly as claimed in claim 7, wherein the switch is fixed on the front plate by a bracket, the bracket comprises a plurality of hooks and the front plate correspondingly defines a plurality of apertures engagingly receiving the hooks.

15. The bezel assembly as claimed in claim 7, wherein the switch comprises a trigger actuated the relaying member.

16. A bezel assembly for an electronic device as a user accessible side thereof, comprising:

a bezel adapted to be attached to an electronic device for providing a user accessible side;

a recess defined in said bezel from said user accessible side to provide an access to said electronic device along a predetermined line, a component of said electronic device offset from said predetermined line;

a button movably disposed in said recess along said predetermined line and exposable at said access; and a relaying member resiliently attached to said bezel and neighboring said button, said relaying member extendable away from said predetermined line so as to be reachable to said component, and said relaying member engagable with said button due to movement of said button at said access so as to reach said component and further actuate said component.

17. The bezel assembly as claimed in claim 16, wherein said component is a switch comprises a trigger to be actuated by said relaying member.

18. The bezel assembly as claimed in claim 16, wherein said relaying member has a middle board and a pair of vertical boards extending therefrom along two opposing directions so that one of said pair of vertical boards is reachable to said component and the other is engagable with said button.

19. A bezel assembly for an electronic device as a user accessible side thereof, comprising:

a bezel adapted to be attached to an electronic device for providing a user accessible side;

a recess defined in said bezel from said user accessible side to provide an access to a component of said electronic device;

a button snugly disposed in said recess and movable therein to be exposable at said access; and a relaying member resiliently attached to said bezel and located in a moving path of said button in said access, a portion of said relaying member located in said moving path being larger than a sectional size of said button in said access, and another portion of said relaying member reachable to said component to actuate said component when said button engages with said portion of said relaying member to drive said another portion of said relaying member to reach said components, movement of said button in said recess being limited by said portion of said relaying member located in said moving path.

20. The bezel assembly as claimed in claim 19, wherein said button has a mating shaft extending into said access along said moving path, and portions of said relaying member located in said moving path comprise a resiliently movable vertical board extending next to said access and perpendicular to said moving path.

* * * * *